US006344771B1

(12) United States Patent
Tobita

(10) Patent No.: US 6,344,771 B1
(45) Date of Patent: Feb. 5, 2002

(54) STEP-DOWN POWER-SUPPLY CIRCUIT

(75) Inventor: Youichi Tobita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/790,523

(22) Filed: Feb. 23, 2001

(30) Foreign Application Priority Data

Aug. 29, 2000 (JP) ..... 2000-258989

(51) Int. Cl.[7] ..... G05F 3/02
(52) U.S. Cl. ..... 327/544; 323/281; 365/227
(58) Field of Search ..... 323/316, 281; 327/539, 540, 541, 543, 538, 544; 365/226, 227

(56) References Cited

U.S. PATENT DOCUMENTS 5,467,052 A * 11/1995 Tsukada ..... 327/543
5,973,548 A 10/1999 Ukita et al.

FOREIGN PATENT DOCUMENTS

JP 9-147570 6/1997
JP 10-199242 7/1998

* cited by examiner

*Primary Examiner*—Shawn Riley
(74) *Attorney, Agent, or Firm*—McDermott, Will & Emery

(57) ABSTRACT

A first output circuit 2 generates output voltages in accordance with threshold voltages of diode-connected NMOS transistors 12 to 14 of a first voltage-generating circuit 4 and a second output circuit 3 generates output voltage in accordance with threshold voltages of diode-connected NMOS transistors 22 to 25 of a second voltage-generating circuit 8 so that VPC showing the value of a power-supply voltage VCC when an output from the first output circuit 2 is stopped becomes VNC showing the value of the power-supply voltage VCC when the gate of an NMOS transistor 9 is clamped at the sum of threshold voltages of the NMOS transistors 12 to 14 or less.

17 Claims, 8 Drawing Sheets

STEP-DOWN POWER-SUPPLY CIRCUIT

BACKGROUND OF THE INVENTION

1. Field of the Invention

The present invention relates to a step-down power-supply circuit for a semiconductor integrated circuit, particularly to a low-power-consumption step-down power-supply circuit to be effectively used for a low-power-consumption SRAM.

2. Description of the Prior Art

In recent years, because an SRAM consumes a very small power-supply current, for example, 10 $\mu$A or less, under a standby state, it is possible to reduce the power consumption of a battery indispensable for a portable electric appliance. Therefore, a low-power-consumption SRAM is used for a portable electric appliance such as a portable telephone. Moreover, to improve performances and reduce costs, high-density integration of an SRAM is now in progress. However, when the SRAM is high integrated, the gate length of a transistor used decreases and, thereby, the withstand voltage lowers. Therefore, it is necessary to lower the power voltage to be supplied to an SRAM. However, the power-supply voltage of an electric appliance using an SRAM depends not only on the characteristic of the SRAM but also on characteristics of various devices and it is difficult to simply lower the power-supply voltage. Therefore, a step-down power-supply circuit has been used so far in an SRAM.

FIG. 7 illustrates a conventional step-down power-supply circuit. FIG. 8 illustrates the characteristic of the output voltage VDC of the step-down power-supply circuit 100 shown in FIG. 7. In FIGS. 7 and 8, when the power-supply voltage VCC to be supplied to the step-down power-supply circuit 100 is equal to the voltage of the first region, the ratio of the output voltage VDC to the power-supply voltage VCC become 1:1, that is, VDC becomes equal to VCC. However, when the power-supply voltage VCC is equal to the voltage of the second region, it becomes constant at a predetermined value not exceeding the withstand voltage of an SRAM. However, a region in which the output voltage VDC becomes lower than a predetermined value and has a V-shaped characteristic may be present in the second region as shown by A in FIG. 8 depending on setting of the characteristic value of each device used for the circuit in FIG. 7 or fluctuation of characteristics of each device when it is manufactured.

In FIG. 7, the step-down power-supply circuit 100 comprises a first output circuit 106 constituted of P-channel MOS transistors (hereafter referred to as PMOS transistors) 101, 102 and a high-resistance resistors 103 to 105 and a second output circuit 118 constituted of N-channel MOS transistors (hereafter referred to as NMOS transistor) 111 to 115 and a high-resistance resistor 116. The diode-connected NMOS transistors 111 to 114 for respectively connecting a gate with a drain are connected in series in the forward direction and the series circuit constitutes a clamping circuit.

The first output circuit 106 operates in the first region in FIG. 8 so that the output voltage VDC becomes equal to the power-supply voltage VCC in order to secure the operational margin of the SRAM in a region in which the value of the power-supply voltage VCC is small. However, the second output circuit 118 operates in the second region in FIG. 8 and in a region in which the value of the power-supply voltage VCC is large. In the first output circuit 106, the gate voltage VA of the PMOS transistor 101 can be shown by the following equation (a).

$$VA=VCC\times R104/(R103+R104) \quad (a)$$

wherein R103 and R104 represent respective resistance values of the resistor 103 and 104.

The PMOS transistor 101 is turned on when the difference between the gate voltage VA and the power-supply voltage VCC serving as a source voltage becomes equal to or larger than the absolute value |VTP| of the threshold value of the PMOS transistor 101. When the power-supply voltage VCC is kept at the voltage level of the first region, the voltage between the gate and source of the PMOS transistor 101 is lower than the absolute value |VTP| of the threshold voltage and the PMOS transistor 101 is turned off. Therefore, the gate of the PMOS transistor 102 is grounded through the resistor 105. When the power-supply voltage VCC reaches the absolute value |VTP| of the threshold voltage of the PMOS transistor 102, the PMOS transistor 102 is turned on and the output voltage VDC becomes the same value as the power-supply voltage VCC.

When the power-supply voltage VCC further rises, the voltage between the gate and source of the PMOS transistor 101 reaches the absolute value |VTP| of the threshold voltage and the PMOS transistor 101 is turned on. The condition in the above case can be shown by the following equation (b).

$$VCC=VA+|VTP| \quad (b)$$

The power-supply voltage VCC in the equation (b) is defined by the following equation (c) when considering the above equation (a).

$$VPC=VPC\times R104/(R103+R104)+|VTP| \quad (c)$$

The following equation (d) can be obtained from the above equation (c).

$$VPC=(1+R104/R103)\times|VTP| \quad (d)$$

When the PMOS transistor 101 is turned on, the gate voltage of the PMOS transistor 102 becomes equal to the power-supply voltage VCC because the resistor 105 has a very high resistance value and the PMOS transistor 102 is turned off and brought into a cutoff state. That is, VPC becomes equal to the power-supply voltage VCC when an output from the first output circuit 106 ceases.

The second output circuit 118 operates in the second region. In the second output circuit 118, assuming that the threshold voltage of the NMOS transistors 111 to 115 is VTN, no current is supplied to the NMOS transistors 111 to 114 before the gate voltage VB of the NMOS transistor 115 becomes (4×VTN). Thus, the power-supply voltage VCC is applied to the gate of the NMOS transistor 115 through the resistor 116. Therefore, the output voltage VDC output from the NMOS transistor 115 in the first region becomes a value lowered by the threshold voltage VTN of the NMOS transistor 115 from the power-supply voltage VCC and is shown by the following equation (e).

$$VDC=VCC-VTN \quad (e)$$

However, because the output voltage VDC of the first region depends on an output voltage of the PMOS transistor 102 that is higher than the voltage shown by the equation (e), VDC becomes equal to VCC. When the power-supply voltage VCC reaches (4×VTN), the gate voltage VB of the NMOS transistor 115 is clamped at (4×VTN) which has the following relation shown by the equation (f) if the power-supply voltage VCC at the time the gate voltage is so clamped is assumed to be VNC:

$$VNC=4\times VTN \quad (f)$$

Moreover, though it is necessary to assure operations of an SRAM also in a region in which the output voltage VDC has the V-shaped characteristic shown by A in FIG. 8, the value of the power-supply voltage VCC at which the level of the output voltage VDC is minimized in the region depends on each SRAM. Accordingly, problems occur that the product cost rises and the manufacturing period increases because it is necessary to perform tests by changing values of the power-supply voltage VCC bit by bit nearby a region having a V-shaped characteristic and moreover, add tests to be performed with temperature taken into consideration because the V-shaped characteristic region changes with change in temperature.

Therefore, $VNC \leqq VPC$ is a necessary condition in order to prevent the output voltage VDC from having the V-shaped characteristic shown by A in FIG. 8. However, because parameters of devices constituting the above equations (d) and (f) are not directly related to each other, a problem occurs that the condition of $VNC \leqq VPC$ may not be satisfied due to the manufacturing fluctuation that only the threshold voltage of an NMOS transistor rises.

The present invention is made to solve the above problems and its object is to provide a step-down power-supply circuit capable of meeting a condition of $VNC \leqq VPC$ without being influenced by the manufacturing fluctuation and preventing the V-shaped characteristic of the output voltage VDC from occurring due to a change of the power-supply voltage VCC.

The Japanese Patent Laid-Open Publication No. 10-199242 discloses an internal-power-supply-voltage generating circuit for generating an internal power-supply voltage that is not easily influenced by the fluctuation of external power-supply voltages. The Japanese Patent Laid-Open Publication No. 9-147570 discloses a semiconductor potential-supply unit for controlling an internal power-supply potential to be supplied to a semiconductor memory circuit so as to be kept in a constant range and a semiconductor memory using the semiconductor potential-supply unit.

SUMMARY OF THE INVENTION

To this end, the present invention provides a step-down power-supply circuit for stepping down a power-supply voltage supplied from an external unit and outputting the voltage from a step-down power-supply output terminal, which includes a first output circuit section constituted of a first voltage-generating section for dividing and outputting a power-supply voltage by using a resistive device having a characteristic of a resistor and at least one unidirectional device in which current flows in only one direction when a voltage exceeds a predetermined threshold voltage; a first output section for outputting a power-supply voltage to a step-down power-supply output terminal when the power-supply voltage is equal to or lower than a predetermined value VPC in accordance with a voltage output from the first voltage-generating section; a second output circuit section constituted of a second voltage-generating section for dividing and outputting a power-supply voltage by using a resistive device having a predetermined resistance value and a plurality of unidirectional devices so that the power-supply voltage becomes higher than an output voltage of the first voltage-generating section; and a second output section for stepping down a power-supply voltage to a predetermined value when the power-supply voltage exceeds a predetermined value VNC equal to or less than the predetermined value VPC in accordance with a voltage output from the second voltage-generating section and outputting the voltage to a step-down power-supply output terminal.

Preferably, the first voltage-generating section and the second voltage-generating section may be respectively constituted of a clamping circuit in which a resistive device and every unidirectional device are connected in series in the forward direction so that a clamp voltage serving as the sum of threshold voltages of unidirectional devices of the second voltage-generating section becomes higher than a clamp voltage serving as the sum of threshold voltages of the unidirectional devices of the first voltage-generating section.

Preferably, each unidirectional device constituting each clamping circuit of each of the first voltage-generating section and second voltage-generating section may be a diode-connected MOS transistor.

Also preferably, each clamping circuit in the first voltage-generating section and second voltage-generating section constitutes a complementary circuit using MOS transistors having polarities different from each other and clamping circuits of the second voltage-generating section have N-channel MOS transistors more than those of clamping circuits of the first voltage-generating section.

Alternatively, each unidirectional device of each clamping circuit of the first and second voltage-generating circuits may be a PN-junction diode.

Furthermore, at least one of unidirectional devices constituting clamping circuits of the second voltage-generating section may be a diode-connected N-channel MOS transistor.

According to another aspect of the present invention, there is provided a step-down power-supply circuit for stepping down a power-supply voltage supplied from an external unit and outputting the voltage from a step-down power-supply output terminal, which includes a voltage-generating section for dividing a power-supply voltage and outputting two different voltages by using a resistive device having a characteristic of a resistor and a plurality of unidirectional devices in each of which current flows in only one direction when a voltage exceeds a predetermined threshold voltage; a first output section for outputting a power-supply voltage to a step-down power-supply output terminal when the power-supply voltage is equal to or less than a predetermined value VPC in accordance with the lowest voltage output from the voltage-generating section; and a second output section for stepping down a power-supply voltage to a predetermined voltage when the power-supply voltage exceeds a predetermined value VNC smaller than the predetermined value VPC and outputting the voltage to a step-down power-supply output terminal.

Preferably, the voltage-generating section comprises a clamping circuit constituted of a first resistive device, a plurality of unidirectional devices forming a series circuit connected in series with the first resistive device in the forward direction, and a second resistive device connected in parallel with a series circuit in which the first resistive device is connected in series with at least one of the unidirectional devices.

The joint between the second resistive device and a unidirectional device preferably forms an output terminal for a first output section and the joint between the first resistive device and a unidirectional device forms an output terminal for a second output section.

The voltage-generating section may include a clamping circuit constituted of a first resistive device, at least one unidirectional device connected in series with the first resistive device in the forward direction, a second resistive device connected in parallel with a series circuit of the first resistive device and the unidirectional device, a first transistor device connected in series with the second resistive device, a series circuit including a second transistor device and a third resistive device for dividing a power-supply voltage and applying the voltage to a control input terminal of the first transistor device, and a reference-voltage generating section for generating the reference voltage of a predetermined voltage and outputting the reference voltage to an control input terminal of the second transistor device.

Also, the joint between a second resistive device and a first transistor device may alternatively form an output terminal for a first output section and the joint between a first resistive device and a unidirectional device forms an output terminal for a second output section.

Each unidirectional device of a voltage-generating section may be a diode-connected MOS transistor, or a complementary circuit using MOS transistors having polarities different from each other. A PN-junction diode may also be used for each unidirectional device.

Also preferably, a unidirectional device connected to a first resistive device of the voltage-generating section may be a diode-connected N-channel MOS transistor, and each of the above resistive devices may be a MOS transistor.

BRIEF DESCRIPTION OF THE DRAWINGS

The present invention will become readily understood from the following description of preferred embodiments thereof made with reference to the accompanying drawings, in which like parts are designated by like reference numeral and in which.

DESCRIPTION OF THE PREFERRED EMBODIMENTS

First Embodiment

Figure 1:
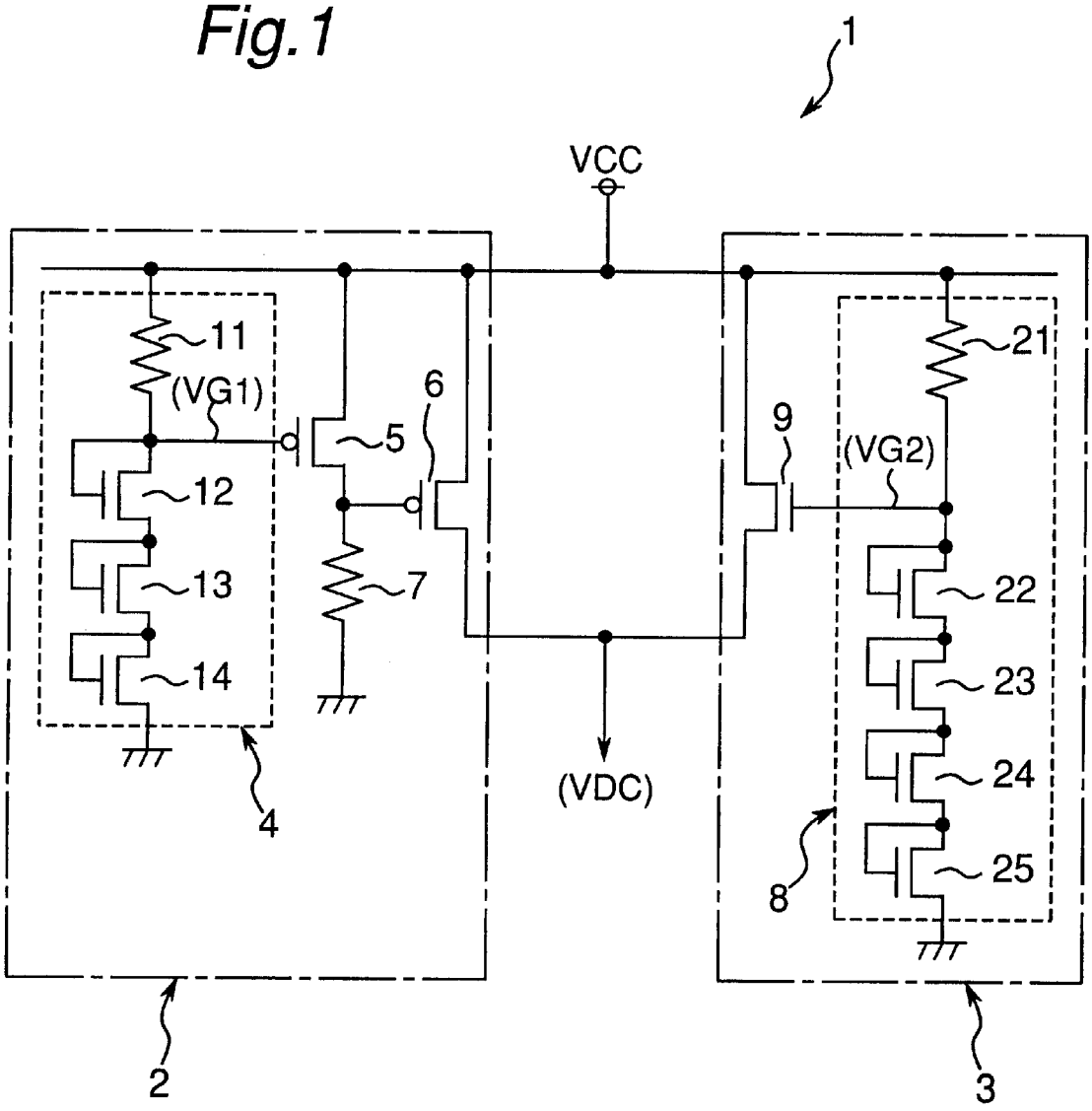
FIG. 1 is an illustration showing a step-down power-supply circuit of a first embodiment of the present invention.

In FIG. 1, the step-down power-supply circuit 1 is provided with a first output circuit 2 to be operated in a region in which the value of the power-supply voltage VCC is small and a second output circuit 3 to be operated in a region in which the value of the power-supply voltage VCC is large, in which higher one of the output voltages of the first output circuit 2 and second output circuit 3 is output from a step-down power-supply output terminal of the step-down power-supply circuit 1 as the output voltage VDC of the step-down power-supply circuit 1.

Moreover, the first output circuit 2 is constituted of a first voltage-generating circuit 4, P-channel MOS transistors (hereafter referred to as PMOS transistors) 5, 6, and a high-resistance resistor 7, in which the PMOS transistors 5, 6, and the resistor 7 constitute an output section. Furthermore, the first voltage-generating section 4 is constituted of a series circuit including a high-resistance resistor 11 and diode-connected N-channel MOS transistors (hereafter referred to as NMOS transistors) 12 to 14 and the series circuit constitutes a clamping circuit.

A series circuit including the first voltage-generating circuit 4, P MOS transistor 5, and resistor 7 are connected between the power-supply voltage VCC and a ground in parallel and the joint between the resistor 11 and NMOS transistor 12 is connected to the gate of the PMOS transistor 5. Moreover, the joint between the PMOS transistor 5 and resistor 7 is connected to the gate of the PMOS transistor 6, the power-supply voltage VCC is applied to the source of the PMOS transistor 6, and the drain of the PMOS transistor forms an output terminal of the first output circuit 2.

The second output circuit 3 is constituted of a second voltage-generating circuit 8 and an NMOS transistor 9 to form the output section of the NMOS transistor 9. Moreover, the second voltage-generating circuit 8 is constituted of a series circuit including a high-resistance resistor 21 and diode-connected NMOS transistors 22 to 25 and the series circuit forms a clamping circuit. The second voltage-generating circuit 8 is connected between the power-supply voltage VCC and a ground and the joint between the resistor 21 and NMOS transistor 22 is connected to the gate of the NMOS transistor 9. Moreover, the power-supply voltage VCC is applied to the drain of the NMOS transistor 9 and the source of the NMOS transistor 9 forms an output terminal of the second output circuit 3.

In the above configuration, the gate voltage G1 of the PMOS transistor 5 of the first output circuit 2 can be shown by the following equation (1).

$$VG1=3\times VTN \quad (1)$$

wherein VTN represents the threshold voltage of an NMOS transistor.

The PMOS transistor 5 is turned on when the difference between the gate voltage VG1 and the power-supply voltage VCC serving as a source voltage becomes equal to or larger than the absolute value |VTP| of the threshold voltage of the PMOS transistor 5. When the power-supply voltage VCC is kept at a voltage level of a small region, the voltage between the gate and source of the PMOS transistor 5 is smaller than the absolute value |VTP| of the threshold voltage and the PMOS transistor 5 is turned off. Therefore, the gate of the PMOS transistor 6 is grounded through the resistor 7 and when the power-supply voltage VCC becomes equal to the absolute value |VTP| of the threshold voltage of the PMOS transistor 6, the PMOS transistor 6 is turned on and the output voltage VDC becomes equal to the power-supply voltage VCC. VTP denotes the threshold voltage of the PMOS transistor.

When the power-supply voltage VCC further rises, the voltage between the gate and source of the PMOS transistor 5 becomes equal to the absolute value |VTP| of the threshold voltage and the transistor 5 is turned on and the condition for this case can be shown by the following equation (2).

$$VCC=VG1+|VTP| \quad (2)$$

Assuming that the power-supply voltage VCC in the equation (2) is defined as VPC, VPC is shown by the following equation (3) by considering the above equation (1).

$$VPC=3\times VTN+|VTP| \quad (3)$$

When the PMOS transistor 5 is turned on, the gate voltage of the PMOS transistor 6 becomes equal to the power-supply voltage VCC because the resistor 7 has a very large resistance value and the PMOS transistor 6 is turned off and brought under a cutoff state. That is, VPC is equal to the value of the power-supply voltage VCC when an output from the first output circuit 2 is stopped.

The second output circuit 3 operates in a region in which the power-supply voltage VCC has a large value. In the second output circuit 3, no current is supplied to the NMOS transistors 22 to 25 before the gate voltage VG2 of the NMOS transistor 9 reaches (4×VTN) when the threshold voltage of the NMOS transistors 9 and 22 to 25 is assumed as VTN. Therefore, the power-supply voltage VCC is applied to the gate of the NMOS transistor 9 through the resistor 21. Thus, the output voltage VDC output from the NMOS transistor 9 in a region where the value of the power-supply voltage VCC is small becomes a value lowered from the power-supply voltage VCC by the threshold voltage VTN of the NMOS transistor 9 and is shown by the following equation (4).

$$VDC=VCC-VTN \quad (4)$$

However, because the output voltage VDC in a region where the power-supply voltage VCC is low depends on an output voltage of the PMOS transistor 6 which outputs a voltage higher than the voltage of the equation (4), VDC becomes equal to VCC. When the power-supply voltage VCC increases and reaches (4×VTN), the gate voltage VG2 of the NMOS transistor 9 is clamped at (4×VTN). When the power-supply voltage VCC for this case is defined as VNC, VNC is shown by the following equation (5).

$$VNC=4\times VTN \quad (5)$$

From the above equations (3) and (5), the following equation (6) is obtained.

$$VPC-VNC=|VTP|-VTN \quad (6)$$

Because the threshold voltage VTP of a PMOS transistor is generally higher than the threshold voltage VTN of an NMOS transistor, |VTP| becomes larger than VTN. Moreover, through the equation (6) shows the difference between threshold voltages of a PMOS transistor and an NMOS transistor, changes for temperature changes at the threshold voltages are offset so as to be hardly influenced by a temperature change because temperature dependencies of the threshold voltages of NMOS and PMOS transistors are the same.

Figure 2:
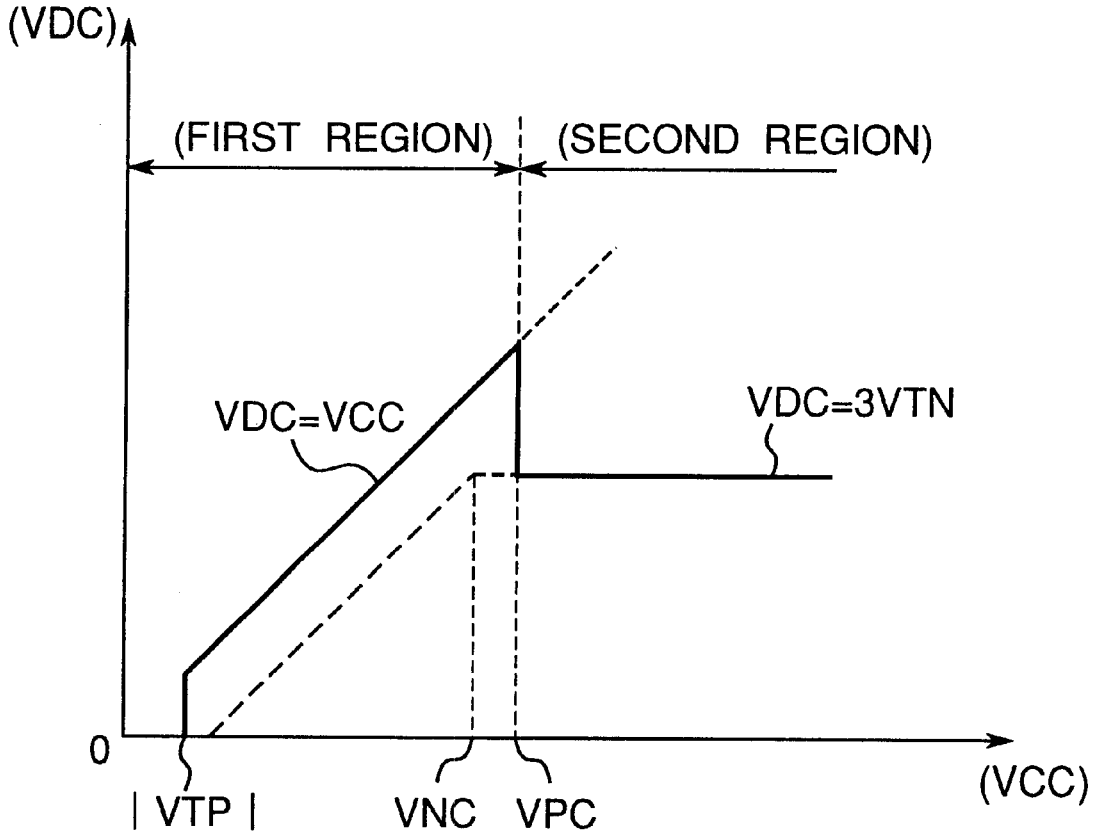
FIG. 2 is an illustration showing characteristics of an output voltage VDC of the step-down power-supply circuit 1 in FIG. 1.

Thus, as shown in FIG. 2, the ratio of the output voltage VDC of the step-down power-supply circuit 1 to the power-supply voltage VCC becomes 1:1 in the first region where the value of the power-supply voltage VCC is small, that is, VDC becomes equal to VCC. Moreover, in the second region where the value of the power-supply voltage VCC is large, the output voltage VDC become constant at (3×VTN) which is a predetermined value not exceeding the withstand voltage of an SRAM and it is found that there is not a region where the output voltage VDC becomes lower than the predetermined value and has a V-shaped characteristic.

Figure 3:
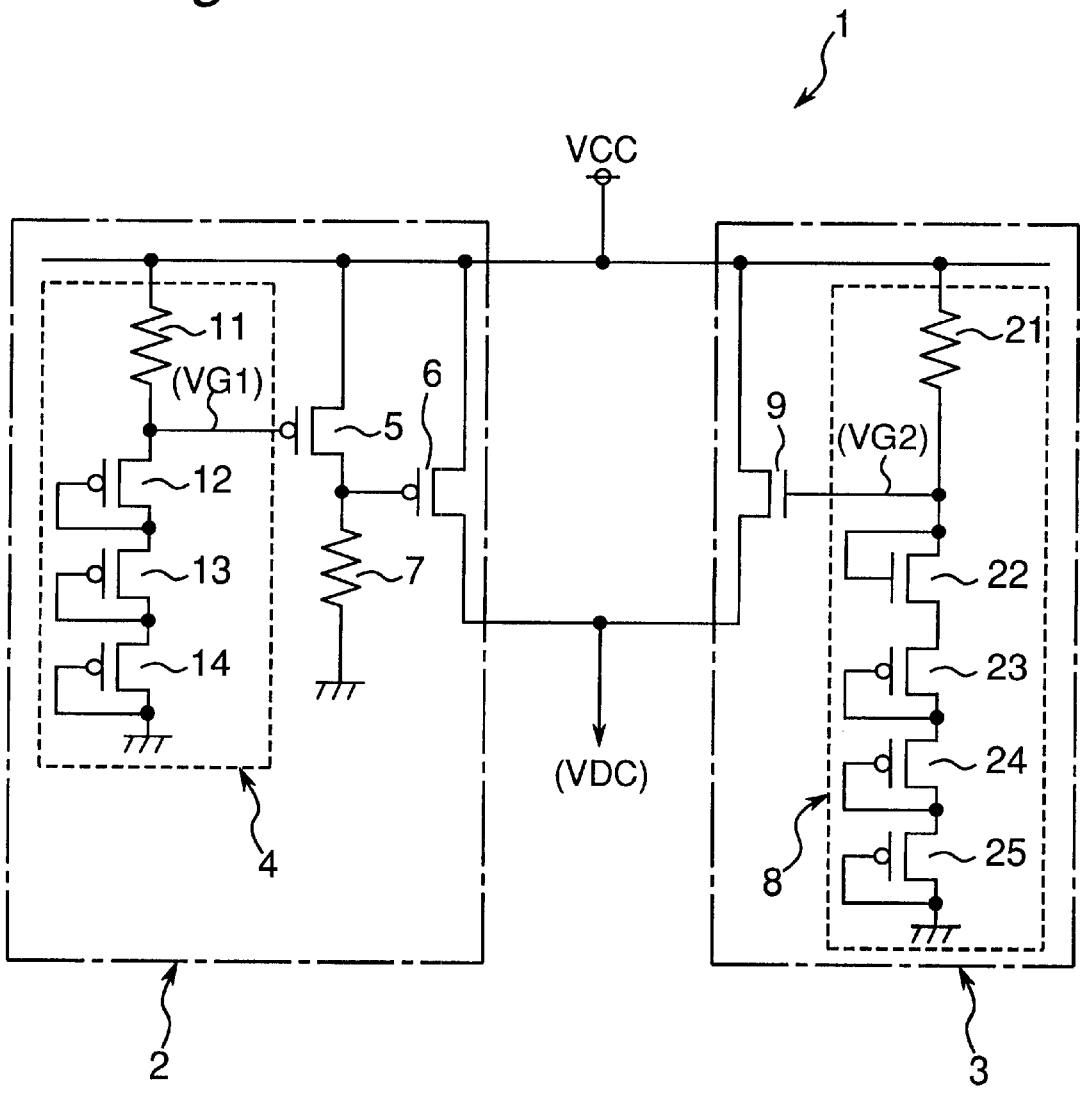
FIG. 3 is an illustration showing another step-down power-supply circuit of the first embodiment of the present invention.
Figure 4:
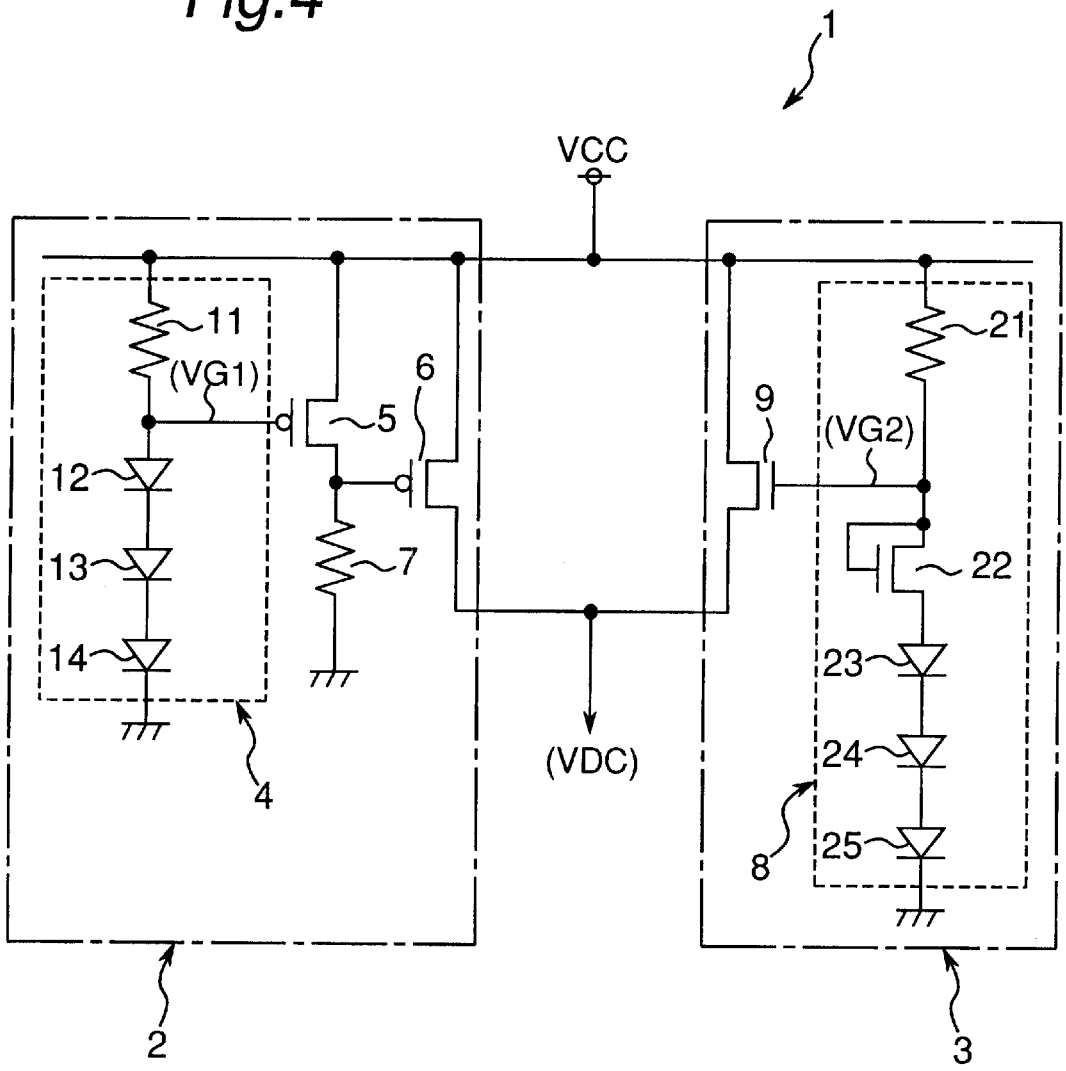
FIG. 4 is an illustration showing still another step-down power-supply circuit of the first embodiment of the present invention.

FIG. 1 shows a case of using a diode-connected NMOS transistor to decide VNC. However, as shown in FIGS. 3 and 4, the NMOS transistors 12 to 14 of the first voltage-generating circuit 4 and NMOS transistors (NMOS transistors 23 to 25 in FIG. 3) excluding at least one of the NMOS transistors 22 to 25 of the second voltage-generating circuit 8 may be replaced with unidirectional devices such as diode-connected PMOS transistors or PN-junction diodes. Even when the above replacement is afforded, the same advantage can be obtained.

At least one NMOS transistor of the second voltage-generating circuit 8 is not replaced with a unidirectional device such as a PMOS transistor or a PN-junction diode in order to satisfy VNC≦VPC while leaving a margin. Therefore, the NMOS transistors 22 to 25 of the second voltage-generating circuit 8 may be replaced with unidirectional devices such as PMOS transistors or PN-junction diodes. Moreover, it is allowed to mix the NMOS transistors 12 to 14 of the first voltage-generating circuit 4 and the NMOS transistors 22 to 25 of the second voltage-generating circuit 8 with PMOS transistors or PN-junction diodes so that VNC becomes equal to or less than VPC.

Moreover, when using unidirectional devices instead of the NMOS transistors 12 to 14 of the first voltage-generating circuit 4 and the NMOS transistors 22 to 25 of the second voltage-generating circuit 8, it is possible to eliminate the difference between devices and errors of the equation (6) by making shapes and electrical characteristics of the above unidirectional devices same.

Thus, the step-down power-supply circuit of the first embodiment generates a voltage output from the first voltage-generating circuit 2 and a voltage output from the second voltage-generating circuit 3 so as to meet the condition of VNC≦VPC by using the threshold voltage of a unidirectional device such as a diode-connected transistor or PN-junction diode. Therefore, because it is possible to prevent a V-shaped characteristic of the output voltage VDC to a change of the power-supply voltage VCC from occurring without being influenced by the manufacturing fluctuation, it is possible to omit various tests necessary when the V-shaped characteristic of the output voltage VDC occurs and decrease the manufacturing cost and the manufacturing period.

Second Embodiment

Though the first embodiment uses the first voltage-generating circuit 4 and second voltage-generating circuit 8, the use may be made of one voltage-generating circuit serving as the first and second voltage-generating circuits 4 and 8. The second embodiment of the present invention uses a voltage-generating circuit serving as the first and second voltage-generating circuits 4 and 8.

Figure 5:
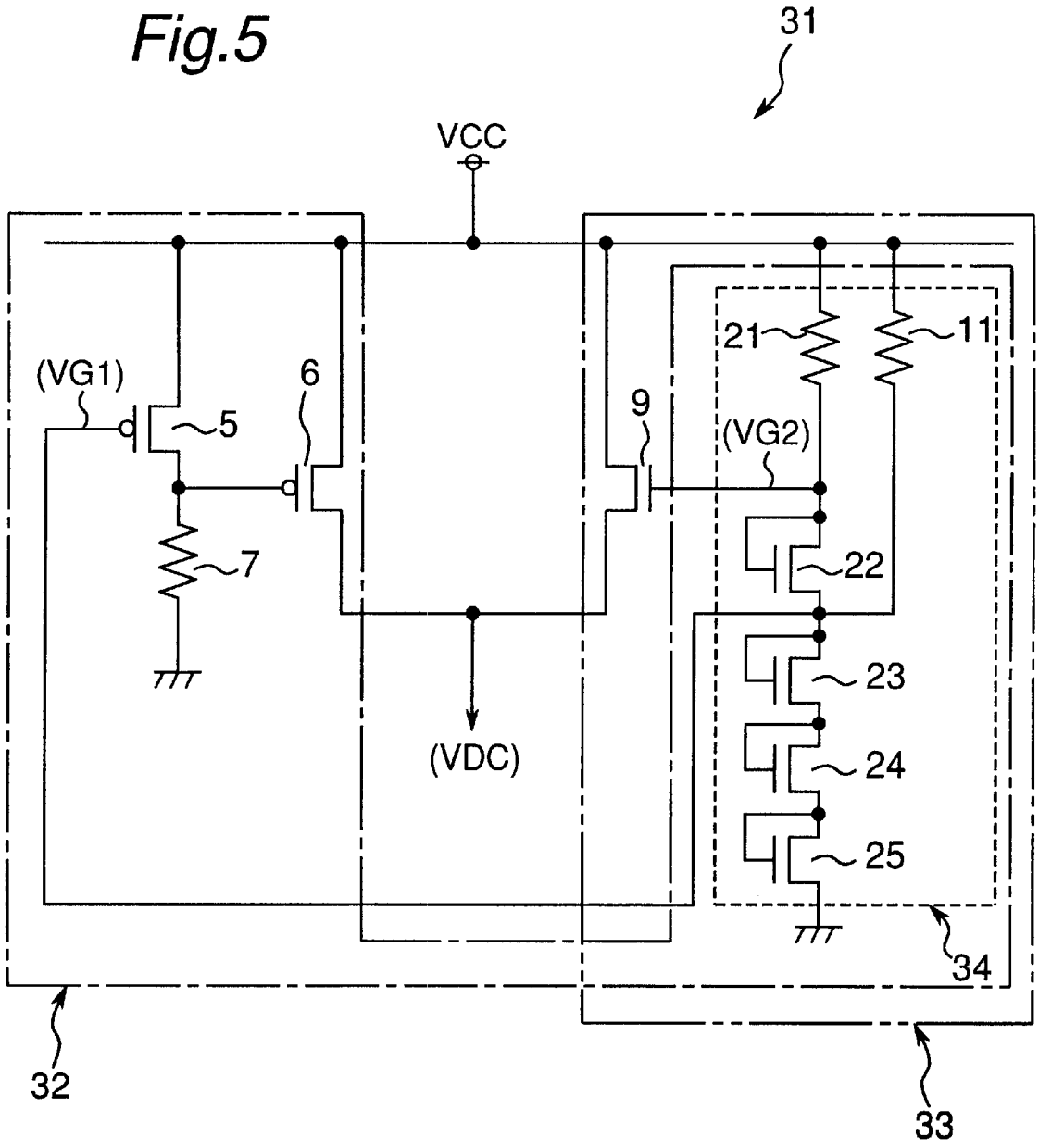
FIG. 5 is a circuit diagram showing a step-down power-supply circuit of a second embodiment of the present invention.

Referring to FIG. 5, a step-down power-supply circuit 31 includes a first output circuit 32 to be operated in a region where the value of the power-supply voltage VCC is small and a second output circuit 33 to be operated in a region where the power-supply voltage VCC is large, in which higher one of output voltages of the firs output circuit 32 and second output circuit 33 is output as the output voltage VDC of the step-down power-supply circuit 31 from a step-down power-supply output terminal serving as an output terminal of the step-down power-supply circuit 31. The first output circuit 32 is constituted of a voltage-generating circuit 34, PMOS transistors 5 and 6, and a resistor 7, in which the PMOS transistors 5 and 6 and the resistor 7 constitute an output section. Moreover, the second output circuit 33 is constituted of a voltage-generating circuit 34 and an NMOS transistor 9, in which the NMOS transistor 9 constitutes an output section. That is, the first output circuit 32 and second output circuit 33 share the voltage-generating circuit 34.

The voltage-generating circuit 34 is constituted of a series circuit in which resistors 11 and 21 and diode-connected NMOS transistors 22 to 25 are connected in series in the forward direction and connected between the power-supply voltage VCC and a ground. In the voltage-generating circuit 34, the resistor 21 and diode-connected NMOS transistors 22 to 25 are connected in series in the forward direction between the power-supply voltage VCC and a ground and the power-supply voltage VCC is applied to the joint between the NMOS transistors 22 and 23 through the resistor 11.

In the first output circuit 32, the voltage-generating circuit 34 and a series circuit including the PMOS transistor 5 and resistor 7 are connected each other in parallel and the joint between the resistor 11 and NMOS transistor 22 in the voltage-generating circuit 34 is connected to the gate of the PMOS transistor 5. Moreover, the joint between the PMOS transistor 5 and resistor 7 is connected to the gate of the PMOS transistor 6 and the power-supply voltage VCC is applied to the source of the PMOS transistor 6 to form an output terminal of the first output circuit 32.

In the second output circuit 33, the joint between the resistor 21 and NMOS transistor 22 is connected to the gate of the NMOS transistor 9. Moreover, the power-supply voltage VCC is applied to the gate of the NMOS transistor 9 and the source of the NMOS transistor 9 forms an output terminal of the second output circuit 33.

According to the above configuration, the resistor 11 of the voltage-generating circuit 34 and NMOS transistors 23 to 25 constitute the first voltage-generating circuit 4 in FIG. 1 serving as a clamping circuit and the resistor 21 of the voltage-generating circuit 34 and NMOS transistors 22 to 25 constitute the second voltage-generating circuit 8 in FIG. 1 serving as a clamping circuit. Because the step-down power-supply circuit 31 performs the same operations as the step-down power-supply circuit 1 shown in FIG. 1, its description is omitted. Similarly to the case of the first embodiment, it is allowed to replace NMOS transistors excluding at least one of the NMOS transistors 22 to 25 of the voltage-generating circuit 34 with unidirectional devices such as diode-connected PMOS transistors or PN-junction diodes. Also in this case, the same advantage can be obtained.

At least one NMOS transistor of the voltage-generating circuit 34 is not replaced with a unidirectional device such as a PMOS transistor or PN-junction diode in order to meet $VNC \leqq VPC$ by leaving a margin. However, it is allowed to replace the NMOS transistors 22 to 25 with PMOS transistors or PN-junction diodes. Moreover, it is allowed to mix in the NMOS transistors 22 to 25 of the voltage-generating circuit 34 with unidirectional devices such as PMOS transistors or PN-junction diodes so that VNC is equal to or less than VPC.

Moreover, when unidirectional devices is used instead of the NMOS transistors 22 to 25 of the voltage-generating circuit 34, it is possible to eliminate the difference between characteristics of devices by making shapes and electrical characteristics of the unidirectional devices same and eliminate errors of the above equation (6).

Thus, in the case of the step-down power-supply circuit of this second embodiment, because the voltage-generating circuit 34 is shared by the first output circuit 32 and second output circuit 33, it is possible to perform the same operations as the step-down power-supply circuit 1 of the first embodiment shown in FIG. 1, obtain the same advantage as the first embodiment, simplify circuits, and reduce costs.

Third Embodiment

In the above second embodiment, when the NMOS transistors 23 to 25 are replaced with unidirectional devices such as PN-junction diodes and assuming that the forward-directional voltage drop of the diodes as Vf, the output voltage VDC is shown by the following equation (7) in a region where the output voltage VDC becomes constant at a predetermined value.

$$VDC=3\times Vf+VTN-VTN=3\times Vf \quad (7)$$

It is preferable that the output voltage VDC of a step-down power-supply circuit does not depend on a temperature or power-supply voltage from the viewpoint of characteristics of an SRAM. However, the forward-directional voltage drop Vf of the diodes has a temperature dependency and there is a problem that a change of the forward-directional voltage drop Vf of the diodes is amplified to three times in accordance with the above equation (7). Therefore, it is possible to eliminate temperature dependency and power-supply-voltage dependency by changing the circuit configuration of the series circuit including the NMOS transistors 23 to 25 in FIG. 5. The third embodiment of the present invention shown in FIG. 6 is a series circuit whose circuit configuration is changed as described above.

Figure 6:
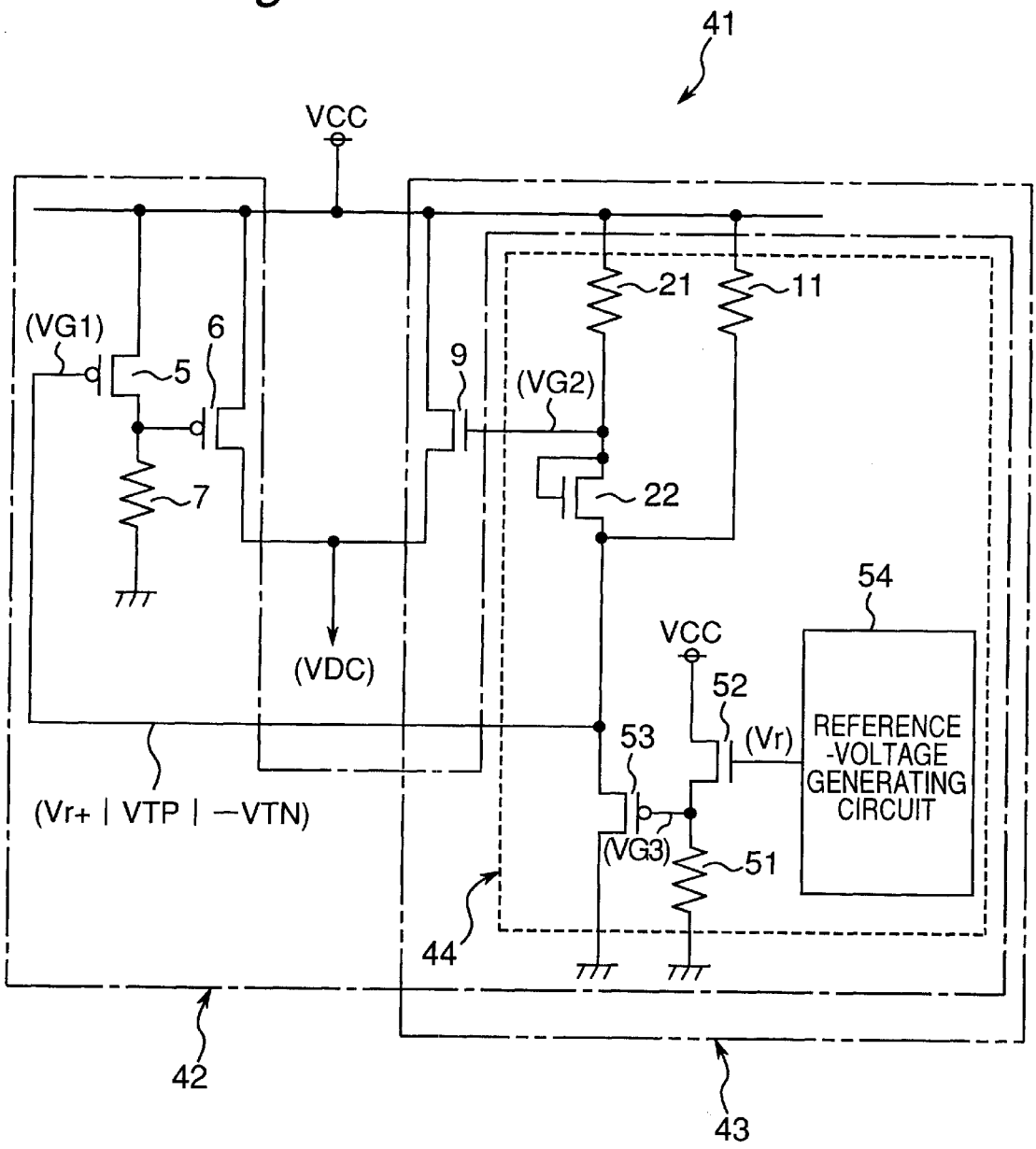
FIG. 6 is a circuit diagram showing a step-down power-supply circuit of a third embodiment of the present invention.
Figure 7:
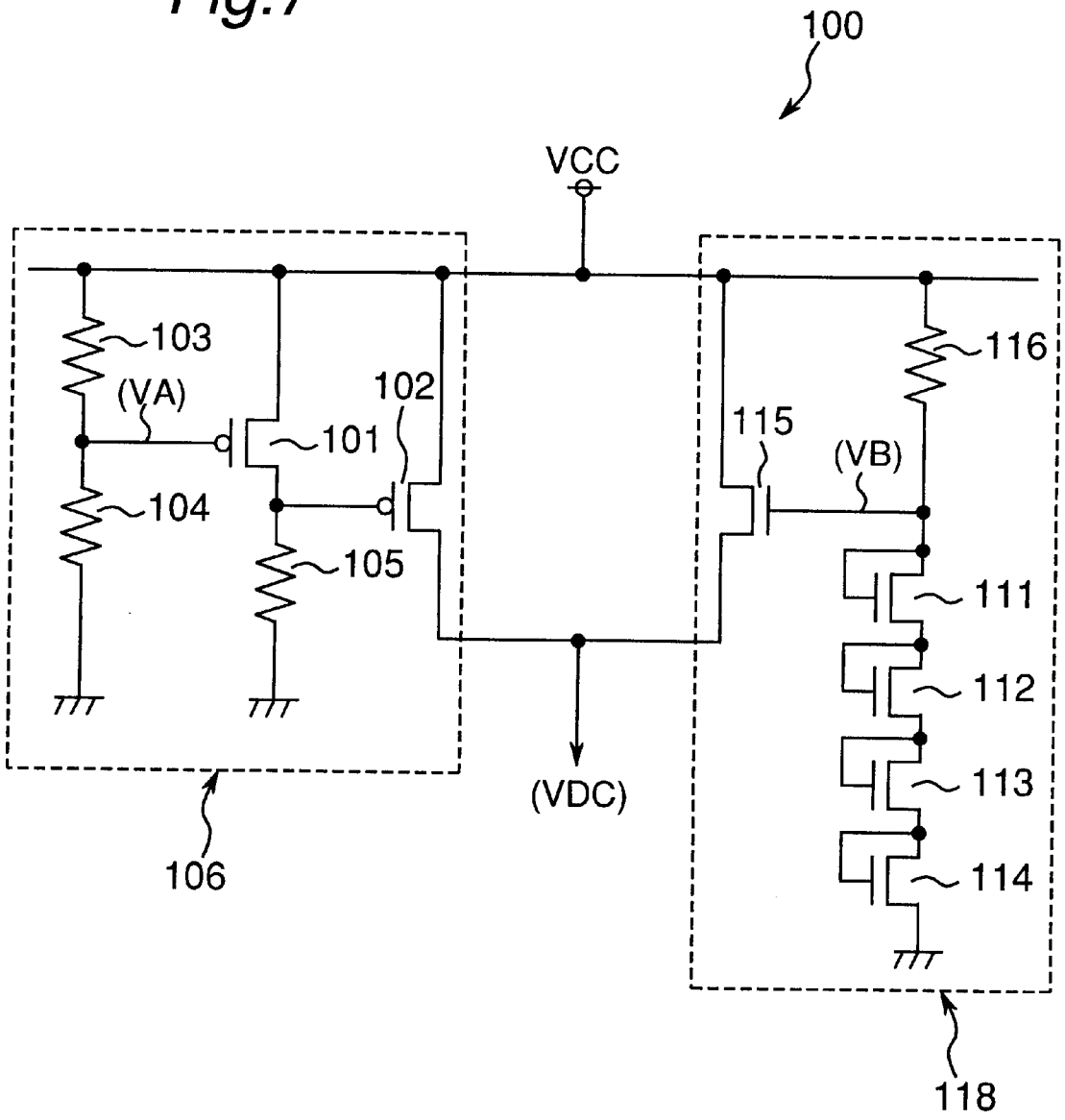
FIG. 7 is an illustration showing a conventional step-down power-supply circuit.
Figure 8:
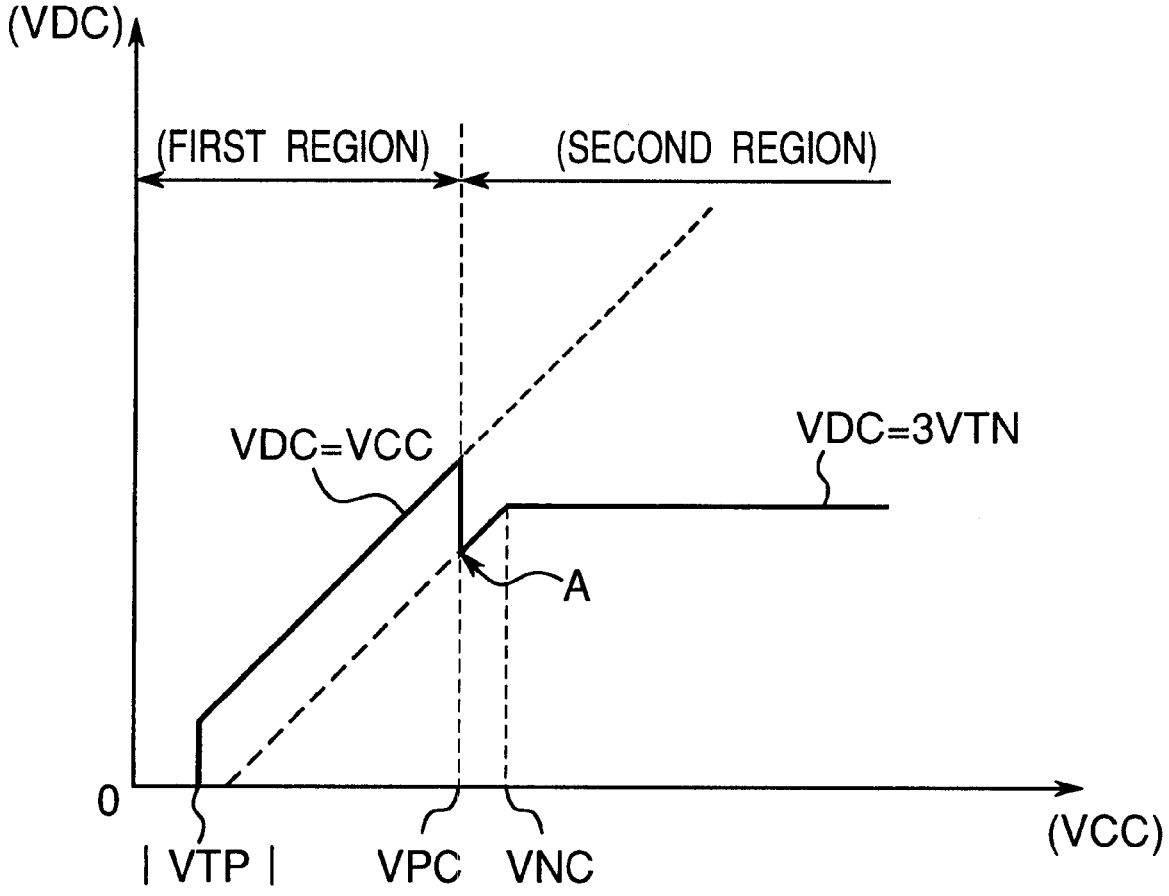
FIG. 8 is an illustration showing characteristics of an output voltage VDC of the step-down power-supply circuit 100 in FIG. 7.

Referring now to FIG. 6, a step-down power-supply circuit 41 includes a first output circuit 42 to be operated in a region where the value of the power-supply voltage VCC is small and a second output circuit 43 to be operated in a region where the value of the power-supply voltage VCC is large and higher one of the output voltages of the first output circuit 42 and second output circuit 43 is output from a step-down power-supply output terminal serving as an output terminal of the step-down power-supply circuit 41 as the output voltage VDC of the step-down power-supply circuit 41.

The first output circuit 42 is constituted of a voltage-generating circuit 44, PMOS transistors 5 and 6, and a resistor 7, in which the PMOS transistors 5 and 6 and the resistor 7 constitute an output section. Moreover, the second output circuit 43 is constituted of a voltage-generating circuit 44 and an NMOS transistor 9, in which the NMOS transistor 9 constitutes an output section. That is, the first output circuit 42 and second output circuit 43 share the voltage-generating circuit 44.

The voltage-generating circuit 44 is constituted of resistors 11, 21, and 51, NMOS transistors 22 and 52, a PMOS transistor 53, and a reference-voltage generating circuit 54 for generating and outputting a predetermined reference voltage Vr. In the voltage-generating circuit 44, the resistor 21, diode-connected NMOS transistor 22, and PMOS transistor 53 are connected in series in the forward direction between the power-supply voltage VCC and a ground and the NMOS transistor 52 and high-resistance resistor 51 are connected in series in the forward direction. Moreover, the power-supply voltage VCC is applied to the joint between the NMOS transistor 22 and the PMOS transistor 53 through the resistor 11. Furthermore, the joint between the NMOS transistor 52 and resistor 51 is connected to the gate of the PMOS transistor 53 and the gate of the NMOS transistor 52 is connected to the reference-voltage generating circuit 54.

In the first output circuit 42, the voltage-generating circuit 44 is connected in parallel with a series circuit including the PMOS transistor 5 and resistor 7 and the joint between the resistor 11 and PMOS transistor 53 of the voltage-generating circuit 44 is connected to the gate of the PMOS transistor 5. Moreover, the joint between the PMOS transistor 5 and resistor 7 is connected to the gate of the PMOS transistor 6, the power-supply voltage VCC is applied to the source of the PMOS transistor 6, and the drain of the PMOS transistor 6 forms an output terminal of the first output circuit 42.

In the second output circuit 43, the joint between the resistor 21 and NMOS transistor 22 is connected to the gate of the NMOS transistor 9. Moreover, the power-supply voltage VCC is applied to the drain of the NMOS transistor 9 and the source of the NMOS transistor 9 forms an output terminal of the second output circuit 43.

In the above configuration, the gate voltage VG3 of the PMOS transistor 53 is shown by the following equation (8).

$$VG3 = Vr - VTN \tag{8}$$

Moreover, the gate voltage VG1 of the PMOS transistor 5 is shown by the following equation (9).

$$\begin{aligned} VG1 &= VG3 + |VTP| \\ &= Vr - VTN + |VTP| \end{aligned} \tag{9}$$

According to the above equation (9), the output voltage VDC is shown by the following equation (10) in a region where the output voltage VDC becomes constant at a predetermined value.

$$\begin{aligned} VDC &= VG1 + VTN - VTN \\ &= Vr - VTN + |VTP| \end{aligned} \tag{10}$$

In the above equation (10), a portion showing the difference between threshold voltages of a PMOS transistor and an NMOS transistor is not easily influenced by a temperature change because the temperature dependency of the threshold voltage of an NMOS transistor is the same as that of the threshold voltage of a PMOS transistor and thereby, changes for temperature changes at threshold voltages are offset. Therefore, by eliminating temperature dependency and power-supply-voltage dependency from the reference voltage Vr, it is possible to eliminate temperature dependency and power-supply-voltage dependency from the output voltage VDC.

Thus, the step-down power-supply circuit of this third embodiment shares the voltage-generating circuit 44 by the first output circuit 42 and second output circuit 43 and obtains the gate voltage VG2 of the NMOS transistor 9 in accordance with the reference voltage Vr generated by the reference-voltage generating circuit 54 so that the gate voltage VG2 does not have temperature dependency or power-supply-voltage dependency. Therefore, it is possible to obtain the same advantage as that of the above second embodiment and eliminate temperature dependency and power-supply-voltage dependency from the output voltage VDC in a region where the output voltage VDC becomes constant at a predetermined value.

In the case of the above third embodiment, the reference-voltage generating circuit 54 is set in the voltage-generating circuit 44. However, it is also allowed to set the reference-voltage generating circuit 54 to the outside of the voltage-generating circuit 44. In this case, the reference voltage Vr is applied to the voltage-generating circuit 44 from an external unit. Moreover, in the case of the above first to third embodiments, the number of unidirectional devices connected in series is an example but the present invention is not restricted to the example. It is preferable to decide the number of unidirectional devices to be connected in series by considering the forward-directional voltage and the level of the output voltage VDC of the unidirectional devices. Moreover, it is allowed to use resistors of the first to third embodiments respectively having a characteristic of a resistor constituted of a MOS transistor.

As hereinbefore fully described, it is clear that with the present invention, it is possible to meet a condition of VNC≦VPC and prevent a V-shaped characteristic of an output voltage to a change of a power-supply voltage from occurring without being influenced by the manufacturing fluctuation. Therefore, it is possible to omit various tests necessary when the V-shaped characteristic of the output voltage occurs, reduce the manufacturing cost, and shorten the manufacturing period.

It is also possible to generate a voltage output from a first output circuit section and a voltage output from a second output circuit section so as to meet a condition of VNC≦VPC by using the threshold voltage of a unidirectional device.

Wherein the diode-connected MOS transistor is used for each of directional devices of the first and second voltage-generating sections, it is possible to equalize temperature dependencies of threshold voltages and thereby, reduce influences of temperature changes.

In the event that clamping circuits of first and second voltage-generating sections respectively constitute a complementary circuit using a MOS transistor so that clamping circuits of the second voltage-generating section have N-channel MOS transistors more than those of clamping circuits of the first voltage-generating section, it is possible to offset temperature changes of threshold voltages of MOST transistors and reduce influences of temperature changes.

Even when the PN-junction diode is used for each of unidirectional devices of the first and second voltage-generating sections, it is possible to generate a voltage output from the first output circuit section and a voltage output from the second output circuit section so as to meet a condition of VNC≦VPC by using the threshold voltage of a PN-junction diode.

Other advantages are also apparent from the foregoing disclosure. However, although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A step-down power-supply circuit for stepping down a power-supply voltage supplied from an external unit and outputting the voltage from a step-down power-supply output terminal comprising:

a first output circuit section constituted of a first voltage-generating section for dividing and outputting the power-supply voltage by using a resistive device having a characteristic of a resistor and at least one unidirectional device in which current flows only in one direction when a voltage exceeds a predetermined threshold voltage and a first output-circuit section for outputting the power-supply voltage to the step-down power-supply output terminal when the power-supply voltage is equal to or lower than a predetermined value VPC in accordance with a voltage output from the first voltage-generating section; and a second output-circuit section constituted of a second voltage-generating section for dividing and outputting the power-supply voltage by using a resistive device having a predetermined resistance value and a plurality of unidirectional devices so that the power-supply voltage becomes higher than an output voltage of the first voltage-generating section and a second output section for stepping down the power-supply voltage to a predetermined voltage when the power-supply voltage exceeds a predetermined value VNC equal to or lower than the predetermined value VPC and outputting the predetermined voltage to the step-down power-supply output terminal.

2. The step-down power-supply circuit according to claim 1, wherein the first voltage-generating section and the second voltage-generating section are respectively constituted of a clamping circuit in which the resistive device and every unidirectional device are connected in series in the forward direction and a clamp voltage which is the sum of threshold voltages of unidirectional devices in the second voltage-generating section is higher than a clamp voltage which is the sum of threshold voltages of unidirectional devices in the first voltage-generating section.

3. The step-down power-supply circuit according to claim 2, wherein each unidirectional device constituting each clamping circuit of the first and second voltage-generating sections is a diode-connected MOS transistor.

4. The step-down power-supply circuit according to claim 3, wherein each clamping circuit of the first and second voltage-generating sections constitutes a complementary circuit using MOS transistors whose polarities are different from each other and the clamping circuit of the second voltage-generating section has N-channel MOS transistors more than those of the clamping circuit of the first voltage-generating section.

5. The step-down power-supply circuit according to claim 2, wherein the each unidirectional device constituting each clamping circuit of the first and second voltage-generating sections is a PN-junction diode.

6. The step-down power-supply circuit according to claim 5, wherein the at least one of the unidirectional devices constituting the clamping circuit of the second voltage-generating section is a diode-connected N-channel MOS transistor.

7. A step-down power-supply circuit for stepping down a power-supply voltage supplied from an external unit and outputting the voltage from a step-down power-supply output terminal, comprising:

a voltage-generating section for dividing the power-supply voltage and outputting two different voltages by using a resistive device having a characteristic of a resistor and a plurality of unidirectional devices in which current flows only in one direction when a voltage exceeds a predetermined threshold voltage;

a first output section for outputting the power-supply voltage to the step-down power-supply output terminal when the power-supply voltage is equal to or lower than a predetermined value VPC in accordance with the lowest voltage output from the voltage-generating section; and a second output section for stepping down the power-supply voltage to a predetermined voltage when the power-supply voltage exceeds a predetermined value VNC equal to or lower than the predetermined value VPC and outputting the power-supply voltage to the step-down power-supply output terminal.

8. The step-down power-supply circuit according to claim 7, wherein the voltage-generating section is constituted of a clamping circuit comprising;

a first resistive device, a plurality of unidirectional devices constituting a series circuit, connected in series with the first resistive device in the forward direction, and a second resistive device connected in parallel with a series circuit in which the first resistive device is connected in series with at least one of the unidirectional devices.

9. The step-down power-supply circuit according to claim 8, wherein the joint between the second resistive device and a unidirectional device forms an output terminal for the first output section and the joint between the first resistive device and a unidirectional device forms an output terminal for the second output section.

10. The step-down power-supply circuit according to claim 7, wherein the voltage-generating section is constituted of a clamping circuit comprising;

a first resistive device, at least one unidirectional device connected in series with the first resistive device in the forward direction, a second resistive device connected in parallel with a series circuit of the first resistive device and the unidirectional device, a first transistor device connected in series with the second resistive device, a series circuit of a second transistor device and a third resistive device to divide and apply a power-supply voltage to an control input terminal of the first transistor device, and a reference-voltage generating section for generating the reference voltage of a predetermined voltage and outputting the reference voltage to a control input terminal of the second transistor device.

11. The step-down power-supply circuit according to claim 10, wherein the joint between the second resistive device and first transistor device forms an output terminal for the first output section and the joint between the first resistive device and a unidirectional device forms an output terminal for the second output section.

12. The step-down power-supply circuit according to claim 7, wherein each directional device of the voltage-generating section is a diode-connected MOS transistor.

13. The step-down power-supply circuit according to claim 12, wherein each unidirectional device of the voltage-generating section constitutes a complementary circuit using MOS transistor whose polarities are different from each other.

14. The step-down power-supply circuit according to claim 7, wherein each unidirectional device of the voltage-generating section is a PN-junction diode.

15. The step-down power-supply circuit according to claim 12, wherein a unidirectional device connected to the first resistive device of the voltage-generating section is a diode-connected N-channel MOS transistor.

16. The step-down power-supply circuit according to claim 1, wherein each of the resistive devices is constituted of a MOS transistor.

17. The step-down power-supply circuit according to claim 7, wherein each of the resistive devices is constituted of a MOS transistor.

* * * * *